US005163615A

United States Patent [19]

Bauer

[11] Patent Number: 5,163,615

[45] Date of Patent: Nov. 17, 1992

[54] GENERATOR FOR CYCLICALLY MOVING JETS

[75] Inventor: Peter Bauer, Germantown, Md.

[73] Assignee: Kurita Water Industries, Ltd., Tokyo, Japan

[21] Appl. No.: 723,963

[22] Filed: Jul. 1, 1991

[51] Int. Cl.[5] ..... B05B 17/04; B05B 3/04

[52] U.S. Cl. ..... 239/12; 239/18; 239/237; 239/381

[58] Field of Search ..... 239/16, 17, 18, 22, 239/380, 381, 227, 237, 240, 263, DIG. 1, 12

[56] References Cited

U.S. PATENT DOCUMENTS

| | | | |
|---|---|---|---|
| 2,639,191 | 5/1953 | Hruby, Jr. | 239/DIG. 1 |
| 2,954,171 | 9/1960 | Hruby, Jr. | 239/237 |
| 2,974,877 | 3/1961 | Hruby, Jr. | 239/237 |
| 3,357,643 | 12/1967 | Hruby, Jr. | 239/227 |
| 3,447,749 | 6/1969 | Hruby, Jr. | 239/237 |
| 3,481,541 | 12/1969 | Hruby, Jr. | 239/17 |
| 4,265,402 | 5/1981 | Tsai | 239/23 |

FOREIGN PATENT DOCUMENTS

| | | | |
|---|---|---|---|
| 889116 | 12/1981 | U.S.S.R. | 239/381 |

*Primary Examiner*—Andres Kashnikow
*Assistant Examiner*—Christopher G. Trainor

[57] ABSTRACT

A generator for cyclically moving jets comprises a housing including a chamber having a circular track therein, a body disposed in the chamber and rollable along the circular track, a hollow revolvable axle coupled to the body and extending to outside of the chamber and rotatably born in and sealed to the housing, a nozzle attached to the axle outside of the chamber for issuing at least one jet misalignedly in relation to the axis of rotation of the axle, and a fluid flow supply leading to an upstream region of the chamber. In operation, fluid flows past the body, through the hollow revolvable axle and issues from the nozzle as a jet. The body rolls along the circular track as a consequence of fluid-dynamic forces acting on the body. A fountain employs the generator for dynamic display of the cyclically moving jets issuing therefrom.

22 Claims, 4 Drawing Sheets

GENERATOR FOR CYCLICALLY MOVING JETS

This invention relates to apparatus and method for generating cyclically moving fluid jets for disbursing from the generator and, in particular, to generating such jets by the action of fluid-dynamic forces upon a body suspended in fluid flow and cyclically movable as a consequence thereof, whereby at least a component of the body motion is utilized to continuously redirect at least one jet formed of the fluid flow into a cyclically moving path. Further more particularly, one of the tasks of the present invention is the generation of cyclically moving discrete jets in three-dimensional patterns that move at adequately slow speeds to be visually discernible and to thusly provide attractive dynamic visual effects that are, for instance, appropriately usable in decorative display fountains.

A variety of devices is known for issuing cyclically moving or repetitively pulsating fluid jets wherein the impetus for the dynamic action of the jets is derived from fluid-dynamic effects of the fluid flow itself. For instance, a class of such devices known as "Fluidic Oscillators" relies on such effects solely without employing moving parts. Typical examples of such devices are disclosed in U.S. Pat. No. 4,184,636. Numerous other devices rely upon moving parts (moved by the flow itself) for redirection and/or interruption of fluid flow therein and for forming of moving flow output patterns or jets. For example, turbine-like mechanisms (using fluid-driven rotors) are employed in some personal shower heads to provide massage effects by virtue of issuance of repetitively interrupted or redirected flow patterns. For instance, U.S. Pat. No. 3,473,736 discloses a pulsating device for water outlet fixtures whose operation relies upon a turbine rotor driving a radially ported valve.

Disclosed in U.S. Pat. No. 4,026,470 is a shower flow modulator for providing a massaging effect that relies upon a hydrodynamically-shaped member which is attracted into and then repulsed from a stream of water passing through the modulator, whereby the direction of travel and intensity of the stream is varied. The hydrodynamically-shaped member is suspended in a ball-socket configuration to permit it to move in oscillating manner.

An example of a device that includes in a flow tube a ball that is prevented from moving axially of the tube by a stop, but that is of such a size relative to the tube that flow past the ball causes rotational and lateral movement thereof, is disclosed in U.S. Pat. No. 3,885,434. Although intended for flowmetering purposes (by detection of the ball motion), clearly this device will cyclically modulate local flow in different localities just downstream from the ball. However, the disclosed device cannot practically produce discrete jets that move in three-dimensional patterns at visually discernible speeds; the latter being indicated, for instance, by the relatively high ball-rotation frequency disclosed (column 3 line 19–21).

Whereas prior-art devices for generating cyclically moving jets or flow patterns are generally not unsatisfactory for particular intended purposes, on the most part they are incapable of providing jets in discrete form that move regularly and uninterruptedly cyclically in three-dimensional patterns. In this respect, "three-dimensional patterns" are to be understood as including jet paths moving through three spatial dimensions (or jet directions moving through two dimensions), as opposed to "two-dimensional patterns" wherein jet motion is substantially within a single plane and producing a fan-like pattern. Further, prior-art devices are generally impractical in providing, without too much mechanical complexity or excessive size, adequately low speeds of jet motion for the jet to be visually discernible and to thusly provide attractive dynamic visual effects.

For instance, whereas the embodiment disclosed in FIGS. 42 and 43 of the above referred to U.S. Pat. No. 4,184,636 shows a device for producing three-dimensional output jet patterns, it has been less than satisfactory to obtain therefrom visually discernible discrete jets unless rather large (and thereby low-frequency) oscillator structures are utilized.

Similarly, in respect to devices employing turbine-like mechanisms, the difficulty of obtaining satisfactory low rotor speeds has precluded practical use for producing adequately low-speed jet motions, unless high-speed rotor motion is employed and geared down or otherwise reduced with attending complexity of mechanism.

The flow modulator disclosed in the above referred to U.S. Pat. No. 4,026,470, being intended for producing massaging effects, appears clearly incapable of producing discrete jets of visually attractive appearance at adequately low speeds of jet motion.

In view of the foregoing, it is a feature of the present invention to provide apparatus and method for generating cyclically moving fluid jets by the action of fluid-dynamic forces upon a body suspended in fluid flow and cyclically movable as a consequence thereof, whereby at least a component of the body motion is utilized to continuously redirect at least one jet formed of the fluid flow into a cyclically moving path. An important feature of an embodiment of the present invention is the generation of cyclically moving discrete jets in three-dimensional patterns that move at adequately slow speeds to be visually discernible and to thusly provide attractive dynamic visual effects that are usable in decorative display fountains.

SUMMARY

In accordance with principles of the present invention, a generator is provided for generating cyclically moving fluid jets by the action of fluid-dynamic forces upon a body suspended in fluid flow and cyclically movable as a consequence thereof, whereby at least a component of the body motion is utilized to continuously redirect at least one fluid jet formed of the fluid flow into a cyclically moving path. The generator comprises a housing including a chamber having an internal circular track. The body includes an external circular periphery and is suspended within the chamber so that it is rollable with its external circular periphery along the internal circular track of the chamber. Fluid flow is supplied to the chamber into an upstream region with respect to the circular track and the fluid flow is conducted out of the chamber from a downstream region with respect to the circular track.

The body is connected to an axle that extends to the outside of the chamber so that at least a component of the body motion is transferred to the axle. The axle is borne in bearing means in the housing and is sealed to the housing. A fluid conduit leads through the axle from the downstream region of the chamber to a nozzle that is attached to the portion of the axle that is disposed outside of the chamber. The nozzle forms and directs at least one fluid jet in a direction that does not coincide with the direction of the axis of rotation of the axle.

In one embodiment of the invention, the body is connected to the axle via a rotational coupling permitting angular misalignments therebetween (for instance a universal joint coupling). Radial and axial bearing means are provided in this embodiment. A spherical bearing to support the axle in the housing against radial and axial loads and permitting simultaneously angular orientation changes of the axle about a center of the spherical bearing is provided in another embodiment instead of the rotational coupling between the body and the axle.

In operation, fluid-dynamic forces acting on the body, by virtue of fluid in the chamber flowing past the body, cause the body to move and roll with its external circular periphery along the internal circular track of the chamber. The rolling motion of the body has a component of rotation. At least this component is transferred via the axle to the nozzle and thereby to the jet issuing therefrom. As the jet is directed differently than the direction of the axis of rotation of the axle (and therewith the nozzle), the initial jet direction describes a path along a conical surface or along a circular plane; the latter, if the jet is directed perpendicularly to the axis of rotation of the axle, whether or not the jet direction intersects this axis. Of course, the initial jet direction can be parallel to and spaced from the axis of rotation of the axle. In the latter case, the initial jet direction describes a path along a cylindrical surface (tending to become a conical surface).

A fountain employs the generator for dynamic display of the cyclically moving jets issuing therefrom. The displayed jets can be stroboscopically illuminated to enhance the visual attraction of the fountain.

BRIEF DESCRIPTION OF THE DRAWINGS

The foregoing and other objects. features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
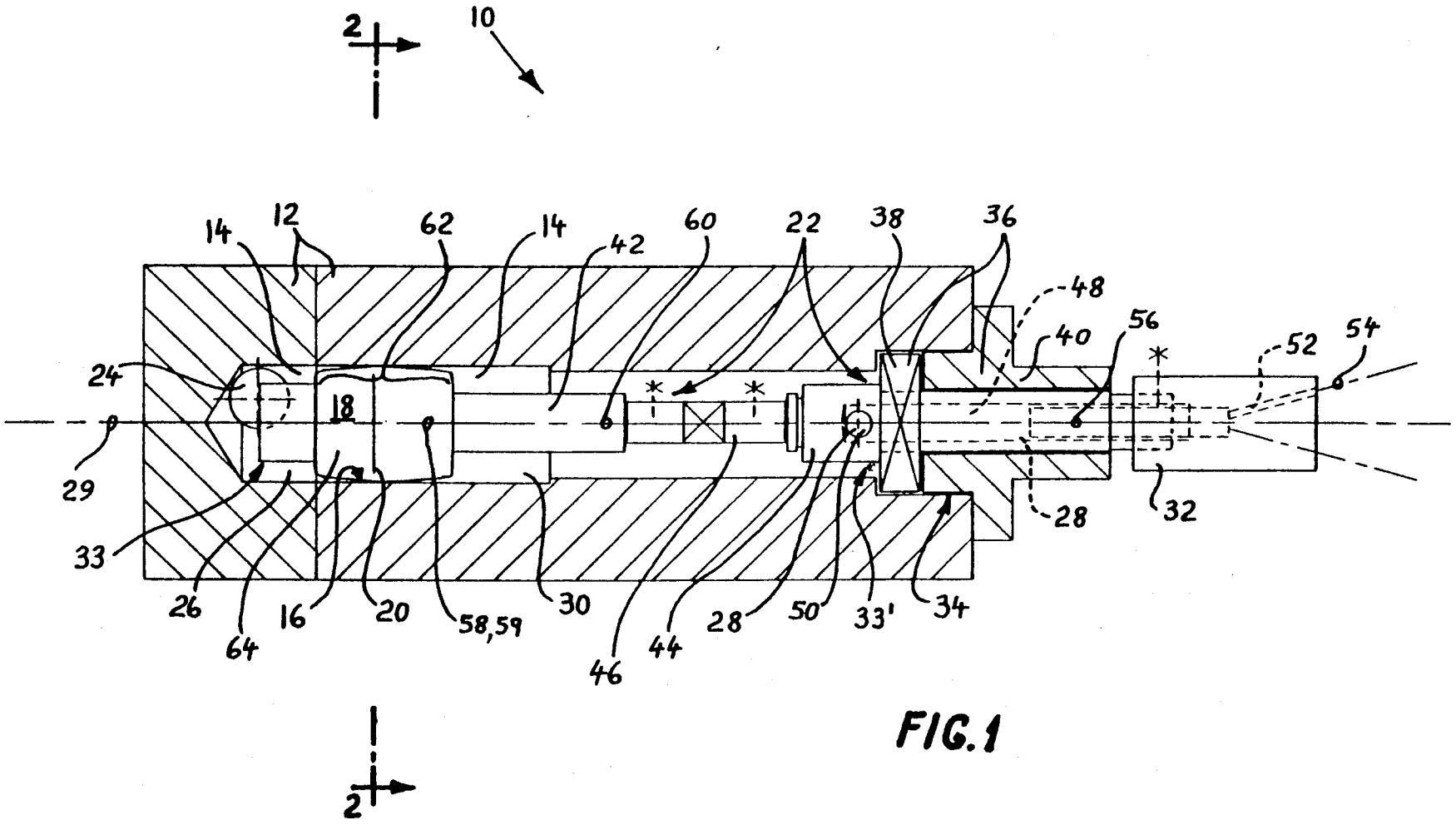
FIG. 1 is a schematic partial longitudinal section view of an embodiment of a generator according to principles of this invention.

Referring now to FIG. 1 of the drawings, a generator 10 comprises a housing 12 including a chamber 14 having an internal circular path or track 16, a body 18 movably disposed in the chamber and including a circular external periphery 20, mechanical transferring means 22 for transferring at least a component of the motion of body 18 to the outside of chamber 14, fluid supply means 24 for supplying fluid flow to an upstream region 26 of chamber 14, fluid conducting means 28 for conducting fluid flow from a downstream region 30 to outside of chamber 14, and nozzle means 32 for issuing at least one fluid jet into ambient.

Chamber 14 (in housing 12) has a chamber axis 29 and a substantially axisymmetrical shape (about axis 29) and generally extends longitudinally between an inlet end 33 and an outlet end 33'. In operation, supply fluid flows in chamber 14 substantially unidirectionally and irreversibly in an overall direction along the chamber's longitudinal extent from fluid supply means 24 at inlet end 33 into upstream region 26, past body 18 into downstream region 30 and to outlet end 33', and farther via fluid conducting means 28 through outlet end 33'.

Chamber 14 has a bore 34 to the outside thereof through housing 12 and, disposed in bore 34, bearing means 36 that include a thrust bearing 38 and a radial bearing 40. Mechanical transferring means 22 include a revolvable axle having a first length portion 42 and a second length portion 44 that are mutually interconnected by connecting means 46. First length portion 42 is attached to body 18. Connecting means 46 includes a universal joint coupling that permits relative angular misalignment between coupled members while transferring rotation therebetween. Second length portion 44 is born in bearing means 36 and includes fluid conducting means 28 in form of an axial conduit 48 that communicates with downstream region 30 via one or more radial holes 50. Nozzle means 32 are attached to the right-hand end of the second length portion 44 and receive fluid flow from axial conduit 48 for issuing from the nozzle means. Second length portion 44 is sealed with respect to housing 12 by sealing means included in bearing 40, as the here employed bearing is a plain bearing, although other bearing types can be used in conjunction with, for example, an 'O' ring as the sealing means.

Fluid supply means 24 include a cavity in the upstream region 26 and a supply conduit thereto, here shown as a lateral bore. It should be understood that supply means 24 can be in any other suitable configuration that provides fluid flow to upstream region 26. For instance, the bore of region 26 can extend to the left to the outside of housing 12 and can have fluid-conducting piping attached and sealed to this bore for supplying fluid from a source not shown here.

Nozzle means 32 include at least one nozzle 52 for issuing a jet therefrom. Nozzle 52 has a directional outlet axis 54 for issuing a jet therealong. Second length portion 44 of the revolvable axle of mechanical transferring means 22 has a rotational axis 56. The orientation of directional outlet axis 54 differs from (or is intentionally misaligned with respect to) the orientation of rotational axis 56. These two axes can, but need not, mutually intersect.

The circular external periphery 20 has a centerline 58 defined perpendicularly thereto. This centerline also defines a body axis 59 coaxially therewith. First length portion 42 of the revolvable axle of mechanical transferring means has a rotational axis 60 that is coaxial with centerline 58. In operation of the generator, rotational axes 56 and 60 are not coaxial, but mutually intersect at the pivot point of the universal joint coupling of connecting means 46.

In the region of the circular external periphery 20, chamber 14 has internal circular track 16. Body 18 is rollable with its circular external periphery 20 along internal circular track 16 by virtue of fluid-dynamic forces exerted onto the body 18 while fluid flows past the body from upstream region 26 to downstream region 30.

The region of chamber 14 at and in the vicinity of the internal circular track 16 is defined as a fluid-dynamically active region 62. The internal wall portion of the chamber in the fluid-dynamically active region is substantially cylindrical, although conical shapes can be employed. As substantially cylindrical or slightly conical wall shapes in the active region are preferred for practical reasons, the depiction in FIG. 1 is intended to be viewed to also represent conical wall shapes in active region 62.

Body 18 includes an external peripheral surface 64 (that includes circular external periphery 20) that is axisymmetric in relation to body axis 59. External peripheral surface 64 is a surface of revolution about body axis 59, the surface having a substantially smoothly arcuate and externally convex generatrix (with respect to body axis 59). As shown, body 18 is barrel-shaped. A spherical body shape can be alternately employed under certain operating conditions. As body 18 is rollable within chamber 14, the largest diameter of the body must be smaller than the inside diameter of the chamber 14 in the vicinity of the body. More particularly also, the diameter of circular external periphery 20 is smaller than the diameter of internal circular track 16.

Figure 2:
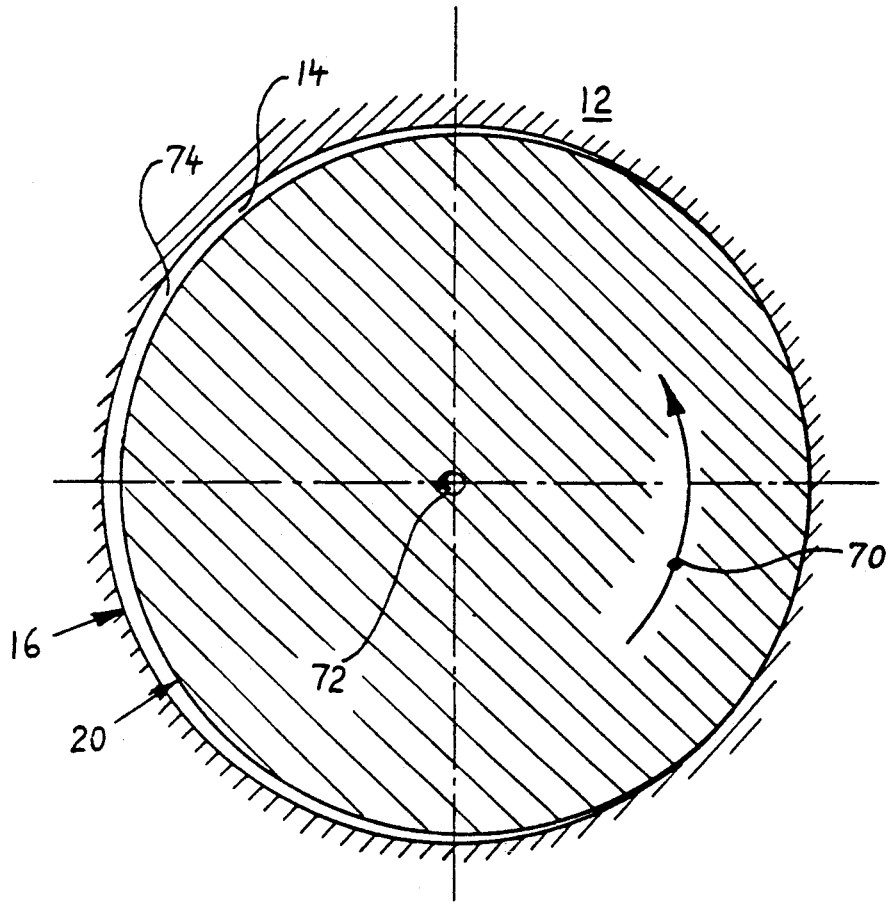
FIG. 2 is a schematic fragmental cross-section in the plane of the internal circular track along section lines 2—2 of FIG. 1.

Referring now to FIG. 2, the shown fragmental cross-section is in the plane of the internal circular track 16 and only approximately in the plane of the circular external periphery 20. FIG. 2 shows body 18 in chamber 14 of housing 12 at an instant in time during operation of the generator according to principles of the invention; i.e. while body 18 rolls with its external circular periphery 20 along internal circular track 16. Further shown in FIG. 2 is a rotation arrow 70 indicating rotation of body 18 about body axis 59 as a consequence of the rolling motion of body 18 along track 16. It will be appreciated that body axis 59 describes a circle while the body rolls along track 16. This circle is indicated here as rolling motion circle 72. It will be further appreciated that the direction of rolling motion is opposite to the direction of the rotation of body 18. A diametral gap 74 between body 18 and the chamber wall of housing 14 provides the flow area for fluid flow to pass.

It should be understood that the rotational speeds of the body rotation and of the rolling motion differ significantly from one another. In absence of any slippage between body and housing, the body rotation speed is related to the rolling motion speed in the ratio of the diametral gap 74 (at the internal circular track 16) divided by the diameter of the circular external periphery 20 of body 18.

Figure 3:
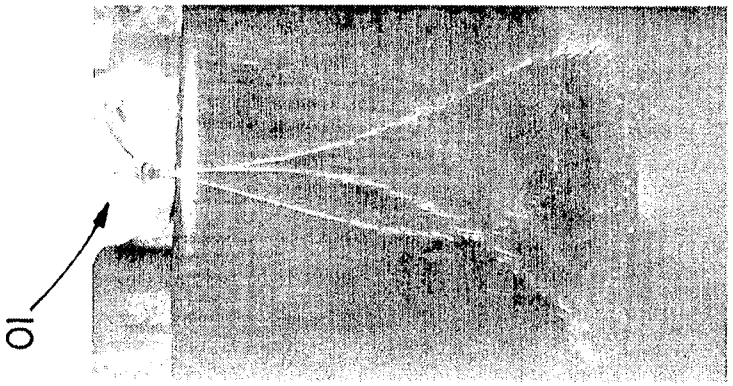
FIG. 3 is a schematic elevational depiction of a typical moving jet pattern (seen at an instant in time) as, for instance, generated by the embodiment shown in FIG. 1.

Referring now to FIG. 3, there is shown a typical moving jet pattern as seen at an instant in time and provided during operation by a generator of the invention, for instance the embodiment shown in FIG. 1. The generator 10 is oriented substantially vertically having three mutually diverging jets directed generally upwardly. The generator can be visualized from this depiction in one of its advantageous uses as a dynamic display fountain. The three jets revolve at a relatively slow speed that facilitates viewing and discerning individual jets as they rise, gradually break up into drops, and eventually fall under the influence of gravity. For example, a speed of jet pattern rotation up to about 150 RPM has been found suitable for such display fountain uses. It will be appreciated that any number of jets can be used. Even a single jet produces an attractive pattern. In this respect, for instance, the depiction of FIG. 3 can be visualized as representing a triple (photographic) exposure of a single revolving jet taken at equal intervals.

FIG. 3 is further also representative of a dynamic display fountain including generator 10 to produce at least one revolving jet, when the rotational speed of the jet is significantly higher so that an individual discrete jet cannot be easily (or not at all) visually discerned by the unaided eye, but when the produced revolving jet pattern is stroboscopically illuminated while being viewed. For instance, illumination at a stroboscopic light flash repetition frequency of three times the rotation frequency of a single jet issuing from generator 10 can provide a view as depicted here. It will be appreciated that the obtained view provides a revolving pattern if the two frequencies are not exactly synchronized, whereby the pattern revolves at the difference frequency.

Figure 4:
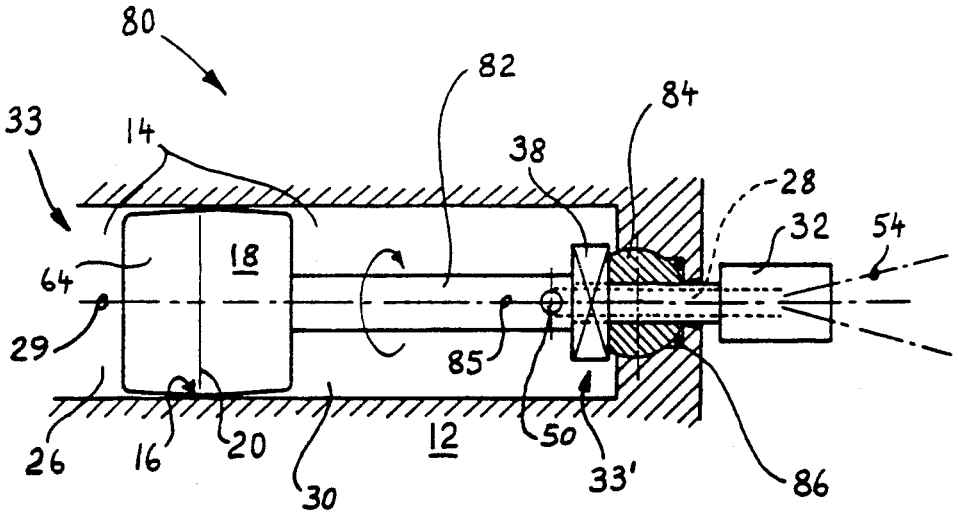
FIG. 4 is, a schematic partial longitudinal section view of another embodiment of the invention; and, FIG. 5 is a schematic elevational depiction of a typical moving jet pattern (seen at an instant in time) as, for instance, generated by the embodiment shown in FIG. 4.

Referring now to FIG. 4, there is schematically shown a generator 80 that is basically similar to generator 10 (of FIG. 1), except that the mechanical transferring means, now designated by numeral 82, are comprised of a substantially one-piece rigid axle assembly that is attached to body 18 at one end and that has nozzle means 32 connected thereto at the other end externally of chamber 14. The axle assembly revolves about an axis 85 and, additionally, takes part in the rolling motion of body 18 along internal circular track 16. Further, generator 80 differs from generator 10 in regard to comprising bearing means that include a spherical pivot bearing 84. Bearing 84 serves to support the axle in different angular orientations in relation to housing 12 while body 18 rolls along internal circular track 16 (see also FIG. 2) and while, as a result of the rolling action, axis 85 moves along a cone surface having the pivot center of the bearing 84 as its apex. Further shown here is an 'O' ring 86 that is included in the sealing means between housing and the axle of mechanical transferring means 82. 'O' ring 86 serves to seal the outer portion of the spherical member of the spherical bearing 84 to housing 12. Inasmuch as the embodiment of FIG. 4 is structurally basically the same as that of FIG. 1 in other aspects, reference is hereby made to such other aspects described hereinbefore in conjunction with FIGS. 1 and 2.

Figure 5:
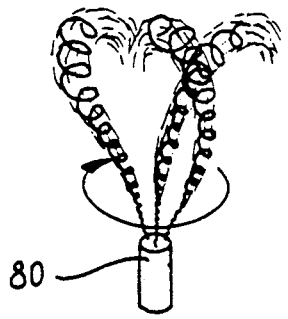

Referring now to FIG. 5, there is shown a typical moving jet pattern as seen at an instant in time and provided during operation by a generator 80 (of FIG. 4). FIG. 5 is similar to FIG. 3, except that the depicted jet pattern includes further a modulational motion in each jet in form of a high-frequency rotation about a centerline of each jet. This modulational motion corresponds and is caused by the rolling motion of body 18, as described hereinbefore in conjunction with FIG. 2 (in particular also in respect to rolling motion circle 72). Generator 80 is again oriented substantially vertically having three mutually diverging jets directed generally upwardly. The generator can be visualized from this depiction in one of its advantageous uses as a dynamic display fountain. The three jets revolve at a relatively slow speed that facilitates viewing and discerning individual jets as they rise, gradually break up into drops, and eventually fall under the influence of gravity. For example, a speed of jet pattern rotation up to about 150 RPM has been found suitable for such display fountain uses. It will be appreciated that any number of jets can be used. Even a single jet produces an attractive pattern. In this respect, for instance, the depiction of FIG. 5 can be visualized as representing a triple (photographic) exposure of a single revolving jet taken at equal intervals.

FIG. 5 is further also representative of a dynamic display fountain including generator 80 to produce at least one revolving jet, when the rotational speed of the jet is significantly higher so that an individual discrete jet cannot be easily (or not at all) visually discerned by the unaided eye, but when the produced revolving jet pattern is stroboscopically illuminated while being viewed. For instance, illumination at a stroboscopic light flash repetition frequency of three times the rotation frequency of a single jet issuing from generator 10 can provide a view as depicted here. It will be appreciated that the obtained view provides a revolving pattern if the two frequencies are not exactly synchronized, whereby the pattern revolves at the difference frequency.

In operation of a generator of the invention (either generator 10 of FIG. 1 or generator 80 of FIG. 4), fluid flow past body 18 in chamber 14 generates fluid-dynamic forces upon the body that cause the body to initially move approximately radially toward the chamber wall and to, thereafter, roll with its external circular periphery 20 along internal circular track 16 of chamber 14. The high-speed rolling motion of body 18 causes a low-speed rotation of the body about an axis 59 that is perpendicular to the center of external circular periphery 20. The rolling motion further causes a precession-like motion of axis 59 in relation to chamber 14 and housing 12, as the body is pivotably supported in a location along its axis 59. The pivotable support is in connecting means 46 (universal joint coupling) in the embodiment of FIG. 1 and it is in the spherical pivot bearing 84 in the embodiment of FIG. 4.

The fluid flow supplied to the generator, subsequent to passing by body 18, is conducted out of the chamber through a conduit disposed within the portion of the axle of mechanical transferring means (22 in FIG. 1; 82 in FIG. 4) that extends to the outside of the chamber 14. This fluid flow is fed through nozzle means 32 and issues to ambient through a nozzle outlet along directional outlet axis 54. As at least the rotational component of the motion of body 18 about its body axis is transferred to nozzle means 32, the jet issuing therefrom effects a revolving jet pattern. This pattern is formed as a result of the jet describing a helical-conical spiral, at least initially upon issuing from the nozzle. This pattern moves regularly and cyclically.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A generator for cyclically moving jets, comprising:

a housing including a chamber having an inlet end, an outlet end, and an internal circular track located between said ends, said chamber extending longitudinally between said ends, said chamber having defined therein a substantially unidirectional and irreversible overall flow direction from said inlet end to said outlet end;

a body movably disposed within said chamber and comprising an external peripheral surface, said external peripheral surface having a circular periphery, said body being rollable with said circular periphery along said internal circular track by virtue of fluid-dynamic forces exerted onto said body while fluid flows in said chamber along said external peripheral surface past said body substantially in said flow direction;

means for mechanically transferring at least a component of the motion of said body to the outside of said chamber, said means for mechanically transferring including means for conducting fluid flow from said outlet end from inside to outside of said chamber substantially in said flow direction;

means for supplying fluid flow into said inlet end directly from outside of said chamber toward and past said body substantially in said flow direction; and, nozzle means for issuing at least one fluid jet into ambient conditions, said nozzle means being disposed externally of said chamber and receiving fluid flow from said means for conducting;

wherein said nozzle means is mechanically coupled outside of said chamber to said means for transferring, said nozzle means being fluid-conductingly coupled to said means for conducting.

2. The generator according to claim 1, said chamber having a bore to the outside thereof, wherein said means for mechanically transferring includes a revolvable axle, said axle being connected to said body and extending from inside to outside of said chamber through said bore, and wherein said housing comprises bearing means for supporting said axle in said housing and means for sealing said axle with respect to said housing.

3. The generator of claim 2, wherein said bearing means includes spherical bearing means for supporting said axle in different angular orientations in relation to said housing.

4. The generator of claim 2, wherein said means for conducting fluid flow includes a fluid conduit disposed in said axle.

5. The generator of claim 4, wherein said nozzle means is attached outside of said chamber to said axle, said fluid conduit being connected to said nozzle means so that fluid from said fluid conduit is conducted into and through said nozzle means.

6. The generator according to claim 1, wherein said chamber includes a fluid-dynamically active region in the region of said internal circular track, said active region having a substantially cylindrical internal wall portion.

7. The generator according to claim 1, wherein said body has a body axis defined therethrough and perpendicularly with respect to the plane of said circular periphery through the center of said circular periphery, said external peripheral surface being axisymmetric with respect to said body axis.

8. The generator according to claim 7, wherein said external peripheral surface is substantially barrel-shaped.

9. The generator according to claim 7, wherein said external peripheral surface has a generatrix about said body axis, said generatrix being substantially arcuate and externally convex.

10. The generator according to claim 1, wherein said means for mechanically transferring comprises a revolvable axle, said axle including a first and a second length portion and means for connecting said first length portion with said second length portion to permit relative angular misalignment while transferring rotation therebetween, wherein said first length portion has a first axis of rotation and said second length portion has a second axis of rotation, said first and second axes mutually intersecting one another, wherein said body has a body axis defined therethrough and perpendicularly with respect to the plane of said circular periphery through the center of said circular periphery, said first length portion being attached to said body, said first axis of rotation being coaxial with said body axis, and wherein said means for conducting includes a fluid conduit disposed in said second length portion.

11. The generator of claim 10, said chamber having a bore to the outside thereof at said outlet end, said second length portion extending from inside to outside of said chamber through said bore, said housing at said bore including bearing means for revolvably supporting said second length portion in said housing, said housing including means for revolvably sealing said second length portion thereto.

12. The generator of claim 11, said second length portion having an external end outside of said chamber, wherein said nozzle means is attached to said external end, said fluid conduit being connected to said nozzle means so that fluid from said fluid conduit is conducted therethrough.

13. The generator according to claim 1, said means for mechanically transferring comprising a revolvable axle, said revolvable axle including at least a portion of said means for conducting, said revolvable axle having said nozzle means attached thereto at a location outside of said chamber for common rotation, said revolvable axle having an axis of rotation, said nozzle means including at least one directional outlet in fluid communication with said means for conducting for issuing said fluid jet therefrom, said at least one directional outlet having a directional axis along which said fluid jet issues, wherein the orientation of said directional axis differs from the orientation of said axis of rotation.

14. The generator according to claim 1, wherein said nozzle means includes a plurality of nozzles for issuing a plurality of mutually diverging jets, said generator being operative as a dynamic display fountain.

15. The generator of claim 2, wherein said bearing means includes a thrust bearing and a radial bearing.

16. A method of generating cyclically moving jets by a generator, said generator comprising a housing including a chamber having an inlet end and an outlet end, said chamber extending longitudinally between said ends, said chamber having defined therein a substantially unidirectional and irreversible overall flow direction from said inlet end to said outlet end, the method comprising steps of:

supplying fluid flow directly into said inlet end and further feeding the fluid flow substantially unidirectionally and irreversibly in said flow direction into an upstream region that is disposed in said chamber upstream with respect to an internal circular track of said chamber, said chamber further including a downstream region and an outlet end downstream from said internal circular track, said chamber having a movable body disposed therein proximally to said internal circular track, said movable body having an external circular periphery;

conveying said fluid flow from said upstream region past said movable body to said downstream region substantially in said flow direction;

conducting said fluid flow from said downstream region toward said outlet end and to the outside of said chamber to a nozzle;

exerting fluid-dynamic forces upon said movable body by virtue of said fluid flow being conveyed during the step of conveying;

rolling said body with said external circular periphery thereof along said internal circular track as a consequence of said fluid-dynamic forces exerted during the step of exerting;

mechanically transferring at least a component of the motion of said body to the outside of said chamber by an axle, said step of mechanically transferring including a step of coupling said axle to said body, said axle having an axis of rotation and being born in said housing and extending therethrough to the outside of said chamber, said axle including a conduit and having said nozzle attached thereto to effect said step of conducting; and, issuing at least one fluid jet through said nozzle to ambient conditions in a direction that differs from the direction of said axis of rotation, the step of issuing being effected during the step of conducting.

17. The method according to claim 16, wherein the step of coupling is effected by a coupling that permits relative angular misalignment between said axis of rotation and said body while transferring rotation between said body and said axle.

18. The method according to claim 16, comprising a step of visually displaying said at least one fluid jet.

19. The method of claim 18, further comprising a step of stroboscopically illuminating said at least one fluid jet.

20. A generator for cyclically moving jets, comprising:

a chamber having a circular track, a longitudinal chamber axis, a normal plane defined substantially orthogonally to said chamber axis, an inlet end, an outlet end, an upstream region at said inlet end, and a downstream region with respect to said circular track, said circular track being located in said normal plane substantially symmetrically about said chamber axis, said chamber having defined therein a substantially unidirectional and irreversible flow direction along said longitudinal chamber axis from said inlet end through said upstream region to said downstream region and to said outlet end;

a body member having a circular periphery, a body axis, a perpendicular plane defined substantially orthogonally to said body axis, said circular periphery being located in said perpendicular plane substantially symmetrically about said body axis, said body member being movably disposed in said chamber and rollable with said circular periphery along said circular track, said body member being rotatable about said body axis as a consequence of rolling along said circular track while fluid flows past said circular periphery in said chamber substantially in said flow direction;

means for supplying fluid flow into said inlet end directly from outside of said chamber through said upstream region and toward and past said body substantially in said flow direction to said downstream region and toward said outlet end;

means for supporting said body in said chamber rollably about said chamber axis and rotatably about said body axis against motion in direction along said chamber axis;

means for mechanically transferring at least the rotating motion of said body about said body axis to outside of said chamber;

means for conducting fluid flow from said downstream region to outside of said chamber substantially in said flow direction; and, nozzle means for issuing at least one fluid jet to ambient conditions in a direction not coinciding with the direction of said body axis, said nozzle means being disposed outside of said chamber, said nozzle means being rotatable about said body axis by said means for mechanically transferring, said nozzle means being provided with fluid flow by said means for conducting.

21. A generator for cyclically moving jets, comprising:

a housing including a chamber having an internal circular track;

a body movably disposed within said chamber and comprising an external peripheral surface, said external peripheral surface having a circular periphery, said body being rollable with said circular periphery along said internal circular track by virtue of fluid-dynamic forces exerted onto said body while fluid flows past said body;

means for mechanically transferring at least a component of the motion of said body to the outside of said chamber, said means for mechanically transferring including means for conducting fluid flow from downstream of said internal circular track from inside to outside of said chamber;

means for supplying fluid flow to said chamber upstream from said internal circular track; and, nozzle means for issuing at least one fluid jet into ambient conditions, said nozzle means being disposed externally of said chamber and receiving fluid flow from said means for conducting;

wherein said nozzle means is mechanically coupled at the outside of said chamber to said means for transferring, said nozzle means being fluid-conductingly coupled at the outside of said chamber to said means for conducting; and, wherein said means for mechanically transferring comprises a revolvable axle, said axle including a first and a second length portion and means for connecting said first length portion with said second length portion to permit relative angular misalignment while transferring rotation therebetween, wherein said first length portion has a first axis of rotation and said second length portion has a second axis of rotation, said first and second axes mutually intersecting one another, wherein said body has a body axis defined therethrough and perpendicularly through the center of said circular periphery, said first length portion being attached to said body, said first axis of rotation being coaxial with said body axis, and wherein said means for conducting includes a fluid conduit disposed in said second length portion.

22. A method of generating cyclically moving jets, comprising steps of:

supplying fluid flow into an upstream region that is disposed upstream with respect to an internal circular track of a chamber that is comprised in a housing, said chamber further including a downstream region with respect to said internal circular track, said chamber having a movable body disposed therein proximally to said internal circular track, said movable body having an external circular periphery;

conveying said fluid flow from said upstream region past said movable body to said downstream region;

conducting said fluid flow from said downstream region to the outside of said chamber to a nozzle;

exerting fluid-dynamic forces upon said movable body by virtue of said fluid flow being conveyed during the step of conveying;

rolling said body with said external circular periphery thereof along said internal circular track as a consequence of said fluid-dynamic forces exerted during the step of exerting;

mechanically transferring at least a component of the motion of said body to the outside of said chamber by an axle, said step of mechanically transferring including a step of coupling said axle to said body, said axle having an axis of rotation and being born in said housing and extending therethrough to the outside of said chamber, said axle including a conduit and having said nozzle attached thereto to effect said step of conducting; and, issuing at least one fluid jet through said nozzle to ambient conditions in a direction that differs from the direction of said axis of rotation, the step of issuing being effected during the step of conducting;

wherein the step of coupling is effected by a coupling that permits relative angular misalignment between said axis of rotation and said body while transferring rotation between said axle and said body.

* * * * *